United States Patent [19]

Gass

[11] Patent Number: 4,921,118

[45] Date of Patent: May 1, 1990

[54] MANUFACTURE OF FILLING MATERIAL

[75] Inventor: Helmut G. Gass, Grand Cayman, Cayman Islands

[73] Assignee: Courtney P. Grover, III, Houston, Tex.

[21] Appl. No.: 175,273

[22] Filed: Mar. 30, 1988

[30] Foreign Application Priority Data

Sep. 4, 1987 [AT] Austria ..... 2244/87

[51] Int. Cl.[5] ..... B65D 87/48

[52] U.S. Cl. ..... 220/88 A; 220/88 R; 29/6.1

[58] Field of Search ..... 220/88 R, 88 A; 29/6.1

[56] References Cited

U.S. PATENT DOCUMENTS

| | | | |
|---|---|---|---|
| 796,183 | 8/1905 | Bradford | 29/6.1 |
| 2,068,421 | 1/1937 | Long et al. | 220/88 A |
| 2,087,170 | 7/1937 | Stephenson | 220/88 A X |
| 2,789,238 | 4/1957 | Staak | 220/88 R X |
| 3,276,096 | 10/1966 | McAleer et al. | 29/6.1 |
| 3,287,094 | 11/1966 | Brown et al. | 220/88 A X |
| 3,349,953 | 10/1967 | Conway | 220/85 |
| 3,356,256 | 12/1967 | Szego | 220/88 |
| 3,650,431 | 3/1972 | Stewart | 220/88 R |
| 3,661,295 | 5/1972 | Grundwall et al. | 220/88 A |
| 4,149,649 | 4/1979 | Szego | 220/88 |
| 4,305,187 | 12/1981 | Iwamura | 29/6.1 |
| 4,361,190 | 11/1982 | Szcqo | 169/48 |
| 4,486,927 | 12/1984 | Hunter | 29/6.1 |
| 4,566,589 | 1/1986 | Poschinger | 220/88 R X |
| 4,613,054 | 9/1986 | Schrenk | 220/88 R |
| 4,621,397 | 11/1986 | Schrenk | 29/6.1 |
| 4,764,408 | 8/1988 | Stedman et al. | 220/88 R X |

FOREIGN PATENT DOCUMENTS

| | | | |
|---|---|---|---|
| 378926 | 10/1985 | Austria . | |
| 705745 | 3/1965 | Canada | 220/88 A |
| 736802 | 6/1966 | Canada | 220/88 A |
| 836363 | 3/1970 | Canada | 215/1 |
| 1072403 | 2/1980 | Canada | 113/32 |
| 1082533 | 7/1980 | Canada | 113/61 |
| 1150682 | 7/1983 | Canada | 217/35 |
| 0003657 | 8/1979 | European Pat. Off. . | |
| 8500113 | 1/1985 | European Pat. Off. . | |
| 241925 | 12/1911 | Fed. Rep. of Germany | 220/88 A |
| 2212269 | 10/1972 | Fed. Rep. of Germany . | |
| 3322328 | 1/1985 | Fed. Rep. of Germany . | |
| 3435457 | 4/1986 | Fed. Rep. of Germany | 220/88 R |
| 2990/84 | 5/1987 | Fed. Rep. of Germany . | |
| 159330 | 4/1984 | Netherlands . | |
| 2028129 | 3/1980 | United Kingdom . | |

*Primary Examiner*—Timothy V. Eley
*Assistant Examiner*—Frances Chin
*Attorney, Agent, or Firm*—Pravel, Gambrell, Hewitt, Kimball & Krieger

[57] ABSTRACT

This invention concerns a process for the manufacture of filling material for hollow spaces, whereby a foil strip is at first continuously provided with intermittent longitudinal cuts and subsequently stretched in a vertical direction, as well as an arrangement of for the manufacture of such fulling material from a continuous foil strip, with a cutting device, that consists of two reciprocal rollers with cutting edges that are intermittently arranged in the circumferential direction, with a stretching unit for the vertical stretching of the cut strips of foil and with a drive as well as with a feed and removal unit.

2 Claims, 2 Drawing Sheets

MANUFACTURE OF FILLING MATERIAL

Applicant claims convention priority based upon the identical application, number 2244/87, filed in Austria on Sept. 4, 1987.

FIELD OF THE INVENTION PRIOR ART

This invention concerns a filling material for hollow spaces that is formed of a lattice-like stretched network.

A device for the manufacture of filling material of the named type from metallic materials is described in CA-PS-1 082 533, which one the one hand permits only the processing of relatively thin foils because of the use of the quasi-longitudinal stretching of the foil strip as the working principal and, on the other hand, produces filling material that, if used to form filling pieces for the hollow spaces, exhibits a relatively small natural stability; this leads to the compounding of the filling material over a period of time, which is disadvantageous and not desirable for many applications.

The application of such filling materials for the explosion-proofing of fuel and other very inflammable liquids is, for example, described in CA-PS-1 072 403. For that purpose, a filing piece made of a stretched metallic network is inserted into the interior space of the container in such a manner, that the latter is almost completely filled, therefore making it possible to dissipate local instances of overheating and preventing explosions of the substances contained in the container. The above-mentioned disadvantage, that the compounding of the filling materials that have been manufactured in accordance with this specification cannot be safely prevented, especially over long periods of time, becomes very obvious; some areas of the interior space of the container may therefore be without the filling material that secures the heat conduction.

A similar problem is also addressed in CA-PS-836 363 whereby the filling pieces are manufactured there of foil strips of different thicknesses to improve the stability of the filling pieces that are made of network-like filling materials; the thicker parts of the foils are supposed to be the carrying parts, while the thinner foil parts are meant to be the heat conducting elements. Beside the fact that thicker filling materials of the type named cannot safely prevent the disadvantageous compounding, the disadvantage of a heavier container or a heavier hollow space provided with this filling material and a reduced useful space comes into play.

Similar arrangements or filling materials are also described in GB-A-2 028 129, in E-A1-3 322 328 and in EP-A1-3 657, whereby in all cases a stretched metal network is used as the filling material for the containers. This again has the disadvantage that such fillings either occupy an unjustifiably large volume in the interior space of the container or that they, especially after a long period of time, exhibit in insufficient stability.

A process as well as an arrangement and also the filling material of the type mentioned at the beginning are also described in AT-PS 378 926. This paper concerns especially stretched material, especially aluminum foil. As has been mentioned before, such stretched material is used for the filling of containers for combustible liquids or gasses to prevent explosion-like application, such filling material may also be used for many different purposes such as, for example, the packaging of sensitive goods, as carriers for catalysts or similar in large containers for chemical or pharmaceutical purposes, etc., whereby a large variety of materials may be used for the foil strips such as paper, cardboard, plastics, metal alloys etc.

Again, the disadvantage of such a filling material, which may be formed into any three-dimensional shape after th stretching, if so desired (adapted to the hollow space to be filled or as individual small filling pieces that are to be inserted subsequently into the hollow space), or of the process and the arrangement for its implementations, that the natural stability of a one filling piece that at first fills the hollow space almost evenly (either as one piece or, as mentioned above, in the form of individual small filling pieces) is relatively small; over a period of time, compounding or caking of the filling material occurs, which one of course reduces or eliminates its effectiveness.

The task of the invention presented is to avoid the named disadvantages of the known processes or the arrangement for their implementation and to improve the process as well as the arrangement and the filling material of the type named at the beginning in such a manner as to avoid the disadvantageous compounding or caking of the filling material.

SUMMARY OF THE INVENTION

For the manufacturing of filling material for hollow spaces, a continuous foil strip (2) is provided with intermittent longitudinal cuts in an irregular arrangement in a cutting device (3) and then stretched in a stretching unit (10) in a vertical direction, whereby a lattice-like stretched network with irregular diamond-shaped openings is formed. The compounding of the filling material is avoided because of the irregular arrangement of the openings.

The invention assumes that this caking is not, as has previously been assumed, the result of the very limited mechanical stability of the thin foil material, but of the compounding of the rhombic pieces that are formed from the individual intermittent longitudinal sections during the vertical stretching. To avoid this compounding, the invention proposes to improve the process named at the beginning in such a manner, that the intermittent longitudinal cuts are arranged in an irregular pattern. The design in accordance with the invention provides in a corresponding manner for the irregular distribution of the cutting edges on the cutting roller. This very simple arrangement achieves that the individual honeycombs of the stretched material can no longer be compounded during the forming of the filling pieces because of their irregular distribution. The filling material or the individual filling piece does therefore remain stable for long periods of time, even if, for example, vibrations occur during the operation of a piece of equipment that is filled with such a filling material, therefore creating favorable conditions for the compounding - for example, a fuel tank in a vehicle.

With such an arrangement of the type mentioned at the beginning, whereby the cutting roller and the counter roller consist of a multitude of cutting disks or intermediate disks and whereby the cutting disks of the cutting roller are fitted at their circumference with teeth that have cutting heads—for example, also indicated at AT-PS-378 926, that has been mentioned at the beginning—a further development of the invention proposes to provide for the irregular division and/or cutting head widths of the teeth of each cutting disk. This permits a very easy manufacture of the cutting device, makes maintenance easier and simplifies the re-sharpening of the exchange of the individual rollers. This very much simplifies the producing of the irregular cuts in the longitudinal direction of the foil that repeat themselves only after a full revolution and which, after the stretching process, form the on-compounding meshed nettings.

Regarding the filling material of the type mentioned at the beginning, the invention proposes that the lattice openings are irregularly shaped; this is assured in an especially preferred design of the invention by making sure that the arrangement and/or the size of the lattice openings is/are irregular.

In a further development of the invention, the reciprocal angular displacement of the individual cutting disks may be irregular which does, for example, permit the use of cutting disks that are equal in regard to the teeth division and the width of the heads of the teeth.

In accordance with a further development of the invention, the individual cutting disks and/or intermediate disks may also be of different thickness, which makes possible the additional controlling of the distribution of the longitudinal cuts and therefore the avoiding of the compounding of the manufactured meshed nettings.

DESCRIPTION OF THE DRAWINGS

The invention is further explained with the help of the schematic representation in the drawing for the manufacture of filling material for hollow spaces from a continuous foil strip.

DESCRIPTION OF THE PREFERRED EMBODIMENT

Figure 1:
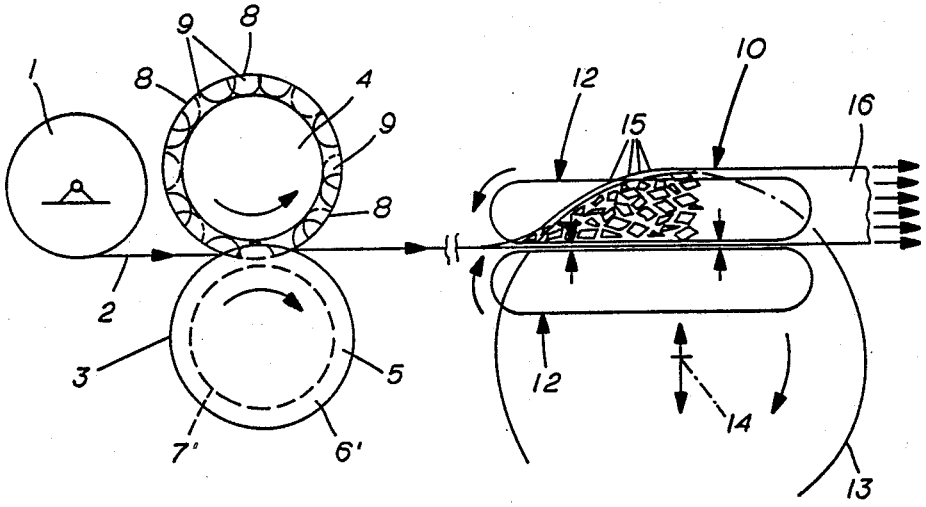
FIG. 1 shows a partial side view of an arrangement.

A foil strip - for example, aluminum foil, plastic foil or paper foil - on a supply roll 1 runs through a cutting device 3 that has two reciprocal rollers 4, 5, with intermittently arranged cutting edges. The cutter roller 4, which is indicated at the top in the drawing, as well as the counter roller 5, consist of a multitude of cutting disks 6 and intermediate disks 7. The cutting disks 6 of the cutting roller 4 are fitted at their circumference with teeth 9 that have cutting heads 8, those distribution in the circumferential direction and whose cutting head width is irregular. The top view in FIG. 2 also indicates that the individual cutting disks 6 and the intermediate disks 7 are of different thicknesses - it is also possible (this is not shown in the drawing) to provide an irregular reciprocal angular displacement of the individual cutting disks of the cutting roller; this is especially advantageous if otherwise equally formed cutting disks are used.

Figure 2:
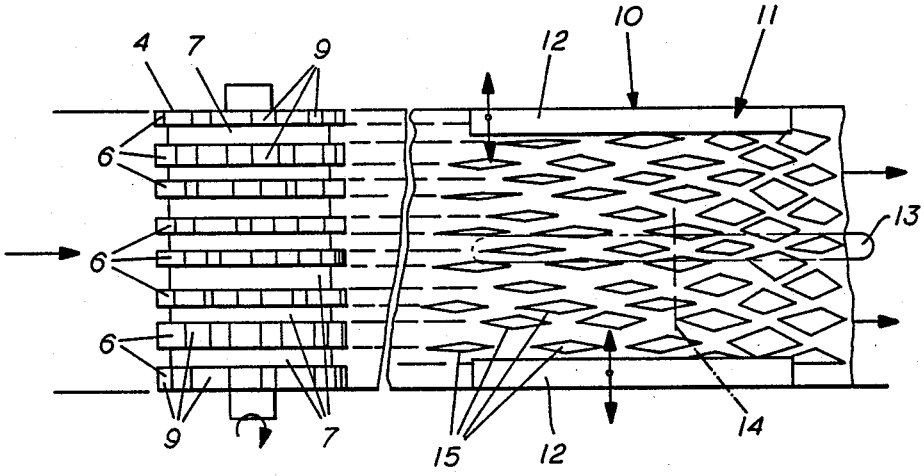
FIG. 2 shows a partial top view.

Because of the interpretation of the cutting heads 8 that are arranged and developed in the named fashion with the continuous cutting disks 6 of the count roller 5 that grasps in the area between the cutting disks 6 of the cutting roller 4, the continuously running foil strip 2 is provided with irregular intermittent longitudinal cuts, as is indicated in FIG. 2 immediately to the right of the cutting roller 4. In the continuous process the cut foil strip 2 moves now to a stretching unit 10 for the vertical stretching. This stretching unit 10 consists mainly of a holding device 11 with two endless pairs of holding chains 12, that hold the lateral edges of the foil strip 2 and move it in a continuous motion in a longitudinal direction and are driven in a manner not shown, that also moves the foil strip 2, the rhombic shapes 15 become also irregular in size and arrangement, therefore safely avoiding an inter-weaving of the individual rhombic shapes 15 and a compounding or caking of the finished filling.

It should also be pointed out that the representation of the cutting device is not shown to scale—in an actual arrangement of the described type, the diameter of the cutting roller and the counter roller would amount to approximately 15 cm—the thickness of the individual cutting disks lies within a range of between 2 and 4 mm—the overall width of the cutting roller and counter roller is approximately 600 mm, whereby only the lateral pairs of holding chains at the stretching unit must be correspondingly adjusted for the processing of thinner foil strip. The individual longitudinal cuts or head width of the cutting disks teeth have dimensions in the range of between 6–10 mm; in that manner and if, for example, aluminum foil with a thickness of between 60 to 80 mm is used, a filling material with a natural stability that occupies only approximately 2 to 3% of the volume of a hollow space to be filled, is obtained.

Figure 3:
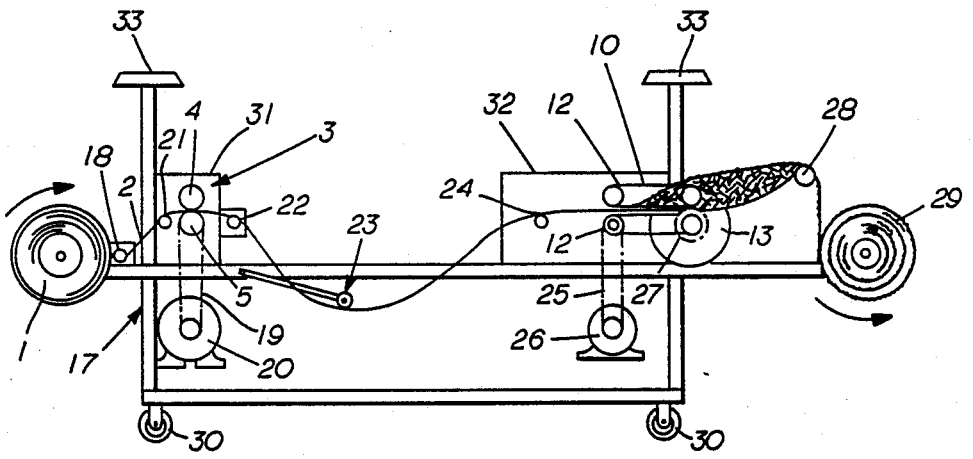
FIG. 3 shows a side view of another arrangement in accordance with the invention.

The device in FIG. 3 basically corresponds to the arrangement shown in FIGS. 1 and 2—equal or functionally equal parts received the same reference symbol; to avoid repetitions, reference is made to the above-mentioned explanations regarding function, systematic arrangement and individual parts thereof.

The base frame 17 of the device for the manufacture of filling material is also shown in FIG. 3; at its left end, as seen in the representation, sits the supply roll 1 for the foil strip 2 to be processed. The latter moves again by means of a guide roller 18 to the cutting device 3, whose rollers 4, 5 correspond basically to those in FIG. 1 and 2. The lower roller 5 is driven here by means of a drive chain 19 by an electric motor 20 that is connected to the base frame 17 (connection now shown). The constant straight movement of the foil strip 2 is assured with the use of the guide rollers 21, 22 and the rollers 4, 5.

By means of a roller stirrup 23 which either rests by its own weight or is pressed by a spring mechanism from above on the sagging and already cut foil strip 2, the rate of revolutions of the roller 5 or the electric motor 20 is varied in a manner not shown here, whereby the drive slows down if the foil strip 2 sags much in the area of the roller stirrup 23 and the drive accelerates if the foil strip 2 is more taut in the area of the roller stirrup 23.

A stretching unit 10 is again arranged after the roller stirrup 23 in the direction of the moving of the foil strip 2, which may also, for example, be designed exactly as indicated in FIGS. 1 and 2. A guide roller 24 is again placed at the feed side of the stretching unit 10, which ascertains a straight feed. The lower of the two pairs of holding chains 12 is driven by an electric motor 26 by means of a drive chain 25, whereby the motor is again connected to the base frame 17 of the device in a manner not shown here. While the electric motor 26 serves to drive the lower pair of the holding chains 12, 15 also serves at the same time to drive the stretching wheel 13, which is achieved by a separate drive chain 27. The ratio of the rate of revolutions can be adjusted to the respective requirements by selecting the appropriate respective drive wheels and driven wheels.

The foil strip that has already been stretched in a vertical direction in a manner described earlier, moves from the stretching wheel 13 by means of another guide roller 28 to a take-up drum 29, which is driven in a manner not shown here, and loosely coils the stretched network.

For completeness sake one must also point out the wheels 30 that serve the purpose of moving the whole arrangement for short distances, the covers 31, 32 at the cutting device 3 or at the stretching unit 10 as well as the lights 33 for the just mentioned units.

It goes without saying that the named drive units, guide rollers etc. may also be substituted by other suitable and proven units; the same holds true, for example, for the supply roll or the take-up drum or also for the roller stirrup used for the control of the dire to the cutting device.

While there has been illustrated and described a single embodiment of the present invention, it will be appreciated that numerous changes and modifications will occur to those skilled in the art, and it is intended in the appended claims to cover all those changes and modifications which fall within the true spirit and scope of the present invention.

What is claimed is:

1. An explosion proof hollow container for holding combustible fluids, and having an improved filling material for use in charging a hollow internal space of the container, comprising:

(a) a plurality of individual filling pieces for charging 9 hollow interior, each formed of a latticed stretched network comprised of a sheet of metallic material having multiple openings therein arranged to form an array of openings, each opening being generally rhombic in shape and the openings being of different sizes spaced over the array.

2. The filling material in accordance with claim l, characterized by the fact, that spacing between the openings varies.

* * * * *